US010214379B2

(12) United States Patent
Hall et al.

(10) Patent No.: US 10,214,379 B2
(45) Date of Patent: Feb. 26, 2019

(54) INFLATOR WITH SOUND-PROOF HOUSING

(71) Applicants: David R. Hall, Provo, UT (US); Jerome Miles, Spanish Fork, UT (US); Davido Hyer, Provo, UT (US); Jedediah Knight, Provo, UT (US)

(72) Inventors: David R. Hall, Provo, UT (US); Jerome Miles, Spanish Fork, UT (US); Davido Hyer, Provo, UT (US); Jedediah Knight, Provo, UT (US)

(73) Assignee: Hall Labs LLC, Provo, UT (US)

( * ) Notice: Subject to any disclaimer, the term of this patent is extended or adjusted under 35 U.S.C. 154(b) by 116 days.

(21) Appl. No.: 15/434,821

(22) Filed: Feb. 16, 2017

(65) Prior Publication Data

US 2018/0229964 A1 Aug. 16, 2018

(51) Int. Cl.
*B65H 75/44* (2006.01)

(52) U.S. Cl.
CPC ..... *B65H 75/4471* (2013.01); *B65H 75/4478* (2013.01); *B65H 2701/33* (2013.01)

(58) Field of Classification Search
CPC ..... B65H 75/4457; B65H 75/4471; B65H 75/4478; B65H 2701/33
See application file for complete search history.

(56) References Cited

U.S. PATENT DOCUMENTS

| | | | | |
|---|---|---|---|---|
| 5,303,866 | A * | 4/1994 | Hawks, Jr. | B05B 9/0403 239/142 |
| 8,544,496 | B2 * | 10/2013 | Gilpatrick | A01G 25/00 137/355.28 |
| 9,352,933 | B2 * | 5/2016 | Moore | B65H 75/42 |
| 9,670,034 | B2 * | 6/2017 | Skotty | F04B 35/06 |
| 2014/0352807 | A1 * | 12/2014 | Liu | B08B 3/026 137/355.27 |
| 2014/0352808 | A1 * | 12/2014 | Liu | B65H 75/42 137/355.27 |

* cited by examiner

*Primary Examiner* — Kevin F Murphy

(57) ABSTRACT

An apparatus is described herein that may generally include an air pump, a rotatable drum, a flexible hose, and first and second housings. The drum may draw in and let out the flexible hose. The pump may be connected to the flexible hose. The first housing may enclose in inner portion of the drum, and may include a first air intake. The pump may be disposed within the first housing. The second housing may surround the drum and may include a second air intake. The flexible hose may pass through the second air intake. The first intake may be aligned perpendicular to the second air intake. Alternatively, the first intake may be aligned parallel to the second air intake on a side of the drum opposite the second air intake. Sound emitted from the pump may pass over, and be absorbed by, the flexible hose within the second housing.

20 Claims, 15 Drawing Sheets

INFLATOR WITH SOUND-PROOF HOUSING

CROSS-REFERENCES

This application refers to, and incorporates, various parts of U.S. patent application Ser. No. 15/413,905 by David R. Hall et al., filed on Jan. 24, 2017, and U.S. patent application Ser. No. 15/426,556 by David R. Hall et al., filed Feb. 7, 2017. Those parts of the referenced applications not explicitly incorporated, by reference or otherwise, are hereby incorporated by reference, such that the entireties of the referenced applications are incorporated herein.

TECHNICAL FIELD

This invention relates generally to the field of inflators and compressors.

BACKGROUND

Inflators and compressors are essential tools in a variety of workshop functions, both in a commercial setting at in home workshops and garages. However, such tools are typically noisy. Some solutions to this problem include placing the pump outside the workshop. However, this requires a significant amount of flexible hose and/or air lines. This may greatly increase the cost and/or inconvenience of the tool. This may additionally be impractical for home garage/workshop settings. Thus, there is still need for solutions to noise created by inflator/compressor pumps.

SUMMARY OF THE INVENTION

An apparatus is described herein that may address some of the problems discussed above in the Background. The apparatus may generally include an air pump, a rotatable drum, a flexible hose, and first and second housings. The drum may draw in and let out the flexible hose. The flexible hose may include a first end having a connection mechanism that connects the flexible hose to an inflatable object, an interchangeable valve, or both. The flexible hose may also include a second end; the pump may be connected to the second end of the flexible hose. The first housing may enclose in inner portion of the drum, and may include a first air intake. The pump may be disposed within the drum within the first housing. The second housing may surround the drum and may include a second air intake. The flexible hose may pass through the second air intake. The first intake may be aligned at least partially perpendicular to the second air intake. The first and second housings may be arranged such that sound emitted from the pump through the first air intake may pass over the flexible hose within the second housing. The flexible hose may at least partially absorb the sound.

Another apparatus is described herein that may address some of the problems discussed above in the Background. The apparatus may generally include an air pump, a rotatable drum, a flexible hose, and first and second housings. The drum may draw in and let out the flexible hose. The flexible hose may include a first end having a connection mechanism that connects the flexible hose to an inflatable object, an interchangeable valve, or both. The flexible hose may also include a second end; the pump may be connected to the second end of the flexible hose. The first housing may enclose in inner portion of the drum, and may include a first air intake. The pump may be disposed within the drum within the first housing. The second housing may surround the drum and may include a second air intake. The flexible hose may pass through the second air intake. The first intake may be aligned parallel to the second air intake on a side of the drum opposite the second air intake. The first and second housings may be arranged such that sound emitted from the pump through the first air intake may pass over the flexible hose within the second housing. The flexible hose may at least partially absorb the sound.

The apparatuses briefly summarized above may address the problems described in the Background in a variety of ways. For example, the double-walled arrangement may allow for additional sound absorption over single-walled designs. The alignment of the air intakes relative to each other may require redirection of sound, which may increase sound attenuation. The alignment of the air intakes relative to the flexible hose may require the sound pass over the flexible hose, increasing absorption of the sound within the apparatus. Other features are described below in the Detailed Description that may increase sound absorption and/or attenuation.

BRIEF DESCRIPTION OF THE DRAWINGS

A more particular description of the inflators briefly described above is made below by reference to specific embodiments. Several embodiments are depicted in drawings included with this application, in which.

DETAILED DESCRIPTION

Figure 1:
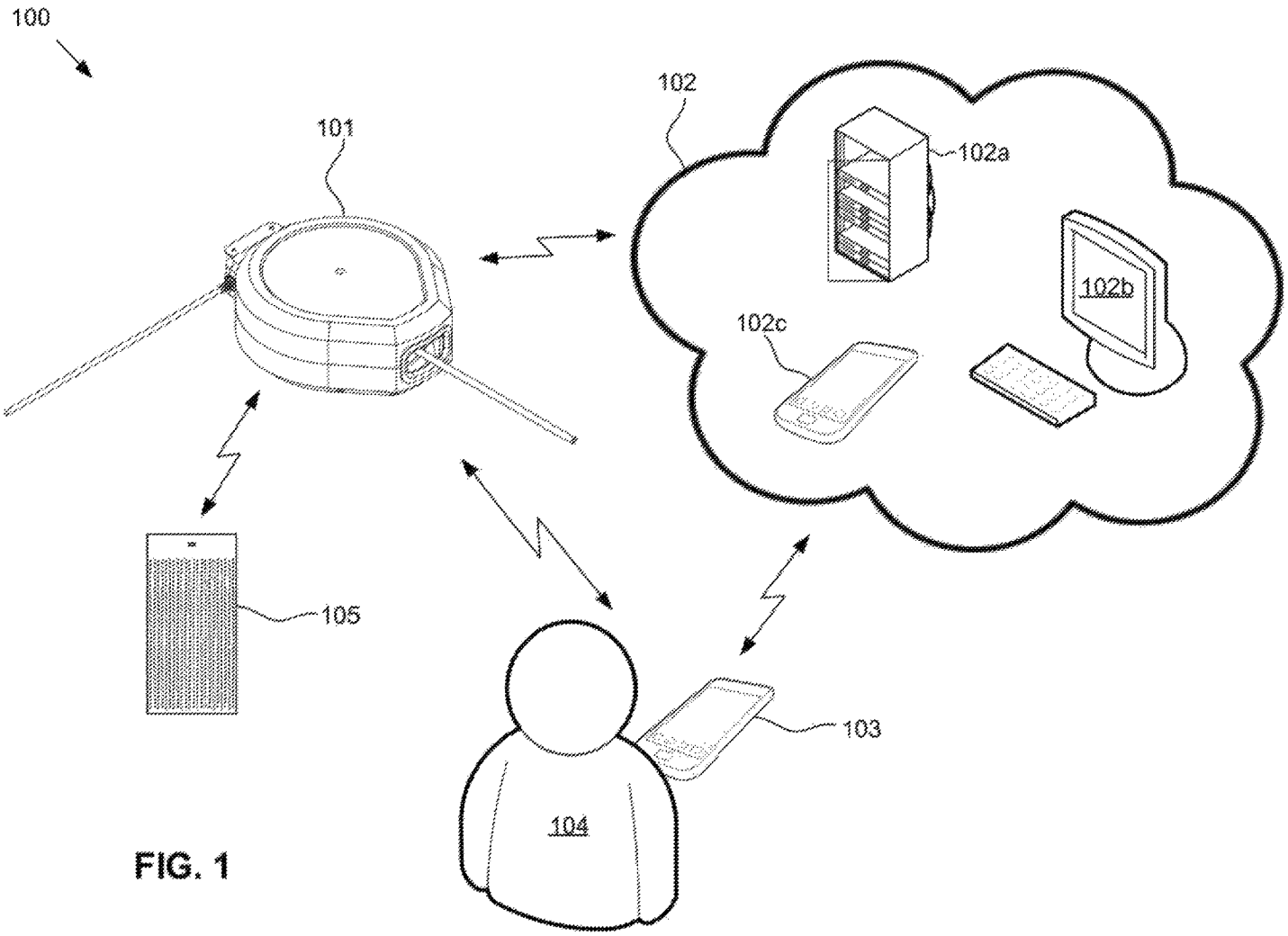
FIG. 1 depicts an embodiment of an inflator system.

A detailed description of embodiments of an apparatus is provided below by example, with reference to embodiments in the appended figures. Those of skill in the art will recognize that the components of the invention as described by example in the figures below could be arranged and designed in a wide variety of different configurations. Thus, the detailed description of the embodiments in the figures is merely representative of embodiments of the invention, and is not intended to limit the scope of the invention as claimed.

The descriptions of the various embodiments include, in some cases, references to elements described with regard to other embodiments. Such references are provided for convenience to the reader, and to provide efficient description and enablement of each embodiment, and are not intended to limit the elements incorporated from other embodiments to only the features described with regard to the other embodiments. Rather, each embodiment is distinct from each other embodiment. Despite this, the described embodiments do not form an exhaustive list of all potential embodiments of the claimed invention; various combinations of the described embodiments are also envisioned, and are inherent from the descriptions of the embodiments below. Additionally, embodiments not described below that meet the limitations of the appended claims are also envisioned, as is recognized by those of skill in the art.

An apparatus is described herein that may generally include an air pump, a rotatable drum, a flexible hose, and first and second housings. The drum may draw in and let out the flexible hose. The flexible hose may include a first end having a connection mechanism that connects the flexible hose to an inflatable object, an interchangeable valve, or both. The flexible hose may also include a second end; the pump may be connected to the second end of the flexible hose. The first housing may enclose in inner portion of the drum, and may include a first air intake. The pump may be disposed within the drum within the first housing. The second housing may surround the drum and may include a second air intake. The flexible hose may pass through the second air intake. The first intake may be aligned at least partially perpendicular to the second air intake. Alternatively, the first intake may be aligned parallel to the second air intake on a side of the drum opposite the second air intake. Parallel and perpendicular refer to imaginary planes formed by the respective intakes and/or openings. The first and second housings may be arranged such that sound emitted from the pump through the first air intake may pass over the flexible hose within the second housing. The flexible hose may at least partially absorb the sound.

The apparatus may be embodied as a variety of devices. In one embodiment, the apparatus may be an inflator. The inflator may be compact and/or portable. The inflator may derive power from mains electricity, from a car battery, or from one or more internal batteries. The internal batteries may be rechargeable and/or exchangeable. The inflator may be affixed to one or more mounting surfaces that support the weight of the inflator. The support surface may be aligned above, below, to the side, or some combination thereof, of the inflator.

The apparatus may be embodied as a compressor. The compressor may include, in addition to at least some of the features described above, an air tank that stores air compressed by the air pump. The air tank may, in certain embodiments, form at least part of the mounting surface that supports the other components of the compressor, including the air pump, the flexible hose, the drum, and/or the first and/or second housings. Additionally or alternatively, the compressor may be mounted to a second mounting surface, which may support the weight of the compressor, including the air tank.

The apparatus may be embodied as a blower that blows pressurized air, such as may be used in a woodshop to clear sawdust from a working surface. The apparatus may also/alternatively be embodied as a vacuum. The air pump may be reversible, such that it may blow and suck air. The air intakes may double as air exhausts when the apparatus is a vacuum. Alternatively, the apparatus may be embodied as a vacuum alone, comprising air exhausts in place of the air intakes.

The air pump may include a motor portion and a pumping portion. The motor and pumping portions may, in some embodiments, be separate components connected by one or more gears. In some embodiments, the motor and pumping portions may be incorporated as a unitary part. The motor may be a variable speed AC or DC motor. The pumping portion may include a plunger, a diaphragm, a piston, or a radial piston, among others.

The drum may be comprised of any of a variety of materials, including plastic, metal, and/or rubber. The drum may take one or more of several shapes, including cylindrical and/or conical. The drum may serve one or more of several functions. The drum may include an external surface around which the air flexible hose is wound. The interior of the drum may be hollow, or may include various structures that support components, such as the pump, inside the drum. For example, the drum may include a divider disposed within the drum dividing the drum along the circumference of the drum. The pump may, in such embodiments, be affixed to the divider within the drum. The divider may serve to separate the pump and various other electronic components from, for example, a rewind mechanism also disposed within the drum. The rewind mechanism may be connected to the drum and the securing mechanism to enable the drum to rotate and rewind the flexible hose onto the drum. For example, the rewind mechanism may include a recoil spring. In embodiments that include the recoil spring, a pawl mechanism may also be included that allows for selective rewinding of the drum.

The rewind mechanism may be incorporated in embodiments without the divider, or may be incorporated in embodiments on the same side of the divider as the pump. For example, in some embodiments, a pivot mechanism may extend within the drum about which the drum may rotate. The pump and/or various other internal components may be mounted to the pivot mechanism within the drum. The pivot mechanism may form a circular shape, and the drum may be supported on the pivot mechanism by one or more bearings. The bearings may allow rotation of the drum with respect to the securing mechanism. The pump may include a motor disposed within the drum and movably coupled to the pivot mechanism. The motor may include a pinion, and the drum may include a rack. The pinion may move between engagement with a pump gear that allows the motor to drive a pumping mechanism and the drum rack. The motor may therefore be used to draw in and/or let out the flexible hose.

The drum and/or the pivot mechanism may include an opening through which the flexible hose passes, allowing connection of the flexible hose to the pump. The flexible hose may be comprised of one or more flexible materials that allow the flexible hose to wrap around the drum and flex during use. For example, the flexible hose may be comprised of one or more of nylon, polyurethane, polyethylene, PVC, and/or one or more natural and/or synthetic rubbers. In various embodiments, the flexible hose may be reinforced with one or more fibers and/or steel cord. The flexible hose may also, in various embodiments include a layer of a sound-attenuating material. Such a material may have a sound transmission class (STC) of at least 25. In some embodiments, the material may have a sound transmission class of at least 35. For example, the sound-attenuating material may comprise mass-loaded vinyl, acoustic foam, rock wool, sorbothane, polyurethane, polystyrene, styrenebutadiene, silicone, fluorosilicone, ethylene acrylic, polyacrylate, neoprene, fluorocarbon, ethylene-propylene, hydrogenated nitrile, nitrile, natural rubber, or combinations thereof. Such materials may have a thickness ranging from 1/32-inch to 2 inches. The sound-attenuating material may be disposed around an outside surface of the flexible hose, and/or may be disposed along an inside surface of the flexible hose. The sound-attenuating material may have a thickness ranging from 1/32-inch to 1 inch, and/or may vary depending on the diameter of the flexible hose. The sound-attenuating material may have a thickness ranging from 5% of the diameter of the flexible hose to 40% of the diameter of the flexible hose.

The first housing may be comprised of any of a variety of materials, including plastic, rubber, and/or metal. The first housing may include a panel removably attached to the drum covering at least one side of the interior of the drum. The first housing may include a second panel removably attached to an opposite side of the drum covering the interior of the drum. The first housing may also/alternatively include the divider. The first air intake may be formed in one of the panels or in the divider. The first air intake may include one or more openings formed along a chord of the first housing (where a chord is an imaginary line connecting two points along the circumference of the housing). The first air intake may include one or more openings formed along one or more radii of the housing. The first air intake may include one or more openings that form one or more intermediate and/or partial circumferences about the axis of the first housing between the axis and the outermost circumference. Additionally or alternatively, The first air intake may include a double-walled baffle. The double-walled baffle may include a first set of one or more openings in an interior wall offset from a second set of one or more openings in an exterior wall. An air path may extend between the openings. The air path may extend between all openings, or several separate, non-conjoined air paths may be formed between the sets of openings.

The first housing may provide support for various components disposed within the drum, such as the pump and/or a printed circuit board. The first housing may rotate with the drum, and may therefore include one or more electrical power transmission mechanisms. Such mechanisms may include, for example, one or more slip rings and/or electrically conductive brushes.

The second housing may be comprised of any of a variety of materials, including plastic, rubber, and/or metal. The second housing may be fixed to the mounting surface and the pivot mechanism may be fixed to, or integrated with, the second housing to allow rotation of the drum by providing a counter force to the force exerted that causes rotation of the drum. The second housing may take many different shapes, and may include any of a variety of features. For example, in some embodiments, the second housing may include one or more mounting brackets. The mounting brackets may mount the second housing to the mounting surface. The second housing may also include and/or support various other components of the apparatus, such as a power supply and/or one or more electrical wires coupling internal components of the apparatus to external power. The power supply may include any of a variety of power supplies, such as a battery or a power cord coupled to mains electricity or some other external power supply. The electrical wires may be coupled to the electrical power transmission mechanism, such as the slip ring or the set of complementary inductive coils. Additionally, a battery may be disposed within the drum. The battery may be rechargeable and/or removeable.

In various embodiments, the second housing surrounds the drum and the flexible hose. The second housing may include various features, such as electrical wiring that may conduct power to the pump, and a mount and/or container for various flexible hose attachments. The second air intake may include rounded edges that prevent damage to the flexible hose that might otherwise be cause by rubbing and/or being forced against the housing. The second air intake may include several openings, only one of which the flexible hose passes through. The second air intake may include one opening, and may have dimensions ranging from 5% larger than the flexible hose to 1000% larger than the flexible hose. A larger opening may permit for a more flexible range of motion of the flexible hose and easier recoiling of the flexible hose. Additionally, one or more brushes may be disposed in the second air intake surrounding a portion of the flexible hose passing through the second air intake. The brushes may clean off the flexible hose as it is wound onto the drum. The brushes may have a density, thickness, or combination thereof, great enough to form a barrier having a STC of at least 10, thereby attenuating sound passing through the second air intake. In some embodiments, the brushes may have a thickness and/or density great enough to form a barrier having an STC of at least 35.

An interior surface of the second housing may be corrugated. This formation may attenuate sound by increasing the absorptive surface area of the interior surface, and/or by increasing redirection of sound waves. Such redirection may increase the occurrence of destructive interference, which may further attenuate sound. A portion of the second housing adjacent to the first air intake may be solid and/or unperforated, and may be parallel to the first housing, reflecting sound back to the first housing and over the flexible hose. A portion of the second housing may comprise a sound-attenuating material, such as the portion adjacent to the first air intake. The sound-attenuating material may have a STC of 25, such as mass-loaded vinyl.

The first housing, the second housing, or both (collectively called "the housings" herein) may include one or more sound-attenuating materials. Such materials may have a STC of at least 25. One such sound-attenuating material may include mass-loaded vinyl. The sound-attenuating material may form the housings, or may form an additional layer of the housings. For example, the housings may be formed of a hardened plastic, such as ABS, and the sound-attenuating material/materials may be attached to the plastic. The thickness of the sound-attenuating material may range from 1/16-inch to 1/2-inch. The housings may include complementary non-linear surfaces that may increase sound absorption and/or sound reflection, which may lead to increased sound attenuation.

The first and second air intakes may be positioned in a variety of ways. In some embodiments, the first air intake may be disposed along a side of the drum adjacent to the drum's interior, and the second air intake may be disposed along the opposite side of the drum. In an embodiment where the drum is conical, this arrangement may be disposed such that the first air intake is adjacent to the wide end of the drum, and the second air intake is adjacent to the narrow end of the drum. In other embodiments, the first air intake may be disposed along the side of the drum adjacent to the drum's interior, and the second air intake may be disposed adjacent to the body of the drum around which the flexible hose wraps.

The connection mechanism at the first end of the flexible hose may, in some embodiments, comprise one or more valves. The valve may be manually controllable by a user, may be electronically controlled, and/or may be wirelessly controlled. Alternatively/additionally, the connection mechanism may include one or more flexible hose couplers, such as a barbed flexible hose fitting, a flexible hose ferrule, and/or a quick-connect coupler. The connection mechanism may include one or more valve adapters, such as any of a variety of stem valve adapters. The flexible hose may be connected to the air pump in any of a variety of similar ways. In some embodiments, the flexible hose may be rotatably connected to the pump to allow the flexible hose to rotate with the drum. This may be beneficial in embodiments where the pump remains fixed as the drum rotates.

The connection mechanism may allow the flexible hose to be connected to any of a variety of inflatable objects. Such objects may include bicycle tires, car tires, toys, and balls, among others. The connection mechanism may also include a constrictor that increases the pressure of air flow from the flexible hose. Such a mechanism may be used as a blower to clear debris and/or dry an object, among other uses. The connection mechanism may, in some embodiments, include a slight conical shape for attaching various vacuum tools.

In various embodiments, a sound barrier may be disposed between the first and second housings perpendicular to the first and second housings. The sound barrier may close off a shortest path between the first and second air intakes, and may redirect sound emitted through the first intake over the flexible hose and through the second air intake. For example, the sound barrier may form a half-circle between the first and second air intakes. The sound barrier may be fixed to, or integrated with, the second housing, and may include bearings between the sound barrier and the first housing that allow the first housing to rotate with the drum.

The apparatus may additionally/alternatively include other sound barriers. For example, a first sound barrier may extend around the circumference of the drum from the drum to the second housing along a first end of the drum. A second sound barrier may extend around the circumference of the drum from the drum to the second housing along a second end of the drum opposite the first end. The first sound barrier may include a third air intake, and the second sound barrier may include a fourth air intake. The third air intake may be disposed on a side of the drum opposite the fourth air intake. The second housing may include a first groove within which the first sound barrier sits, and a second groove within which the second sound barrier sits. The first and second sound barriers may be formed of upturned edges of the drum.

The sound barrier may be formed of any of a variety of materials, including rubber, plastic, and/or metal. The sound barrier may be formed of a sound-attenuating material having a STC of at least 25, such as mass-loaded vinyl.

The apparatus may include various other features. For example, the apparatus may be compact, such as is described in paragraphs [0020]-[0052] and depicted in FIGS. 1-11B of U.S. patent application Ser. No. 15/426,556 by David R. Hall et al. entitled "Compact Inflator." In various embodiments, the apparatus may be wirelessly operable, such as is described in paragraphs [0020]-[0051] and depicted in FIGS. 1-12 of U.S. patent application Ser. No. 15/413,905 by David R. Hall et al entitled "Wirelessly Controlled Inflator." Some material from each reference has been incorporated herein directly, and each reference is incorporated in entirety herein by reference.

FIG. 1 depicts an embodiment of an inflator system. The system 100 includes wirelessly controlled inflator 101, cloud network 102 including network devices 102*a,b,c*, wireless control device 103 operated by user 104, and networked smart device 105. The inflator may communicate with the cloud network, one or more of the cloud network devices, the wireless control device, or the networked smart device via any of a variety of means, including wireless and wired communication means. Such means may include Ethernet, Wi-Fi, Bluetooth, ZigBee, and/or Z-Wave. Other means may include dual modulation on the 902-928 MHz ISM band using FSK and SSFH. Such networks may include local area networks, wireless local area networks, campus area networks, personal area networks, wide area networks, enterprise private networks, metropolitan area networks, storage area networks, and system area networks, among others. Network topologies may include bus, ring, star, and/or mesh topologies.

Although the system is depicted with a wirelessly controlled inflator, other wirelessly controlled devices are also envisioned for use with the system. Thus, in some embodiments, the system includes a wirelessly controlled speaker, a wirelessly controlled light, a wirelessly controlled power cord, a wirelessly controlled motorized lifter, a wirelessly controlled vacuum, a wirelessly controlled radio, and/or one or more wirelessly controlled power tools, among others.

The cloud network may include any of a variety of networks incorporating disparate devices remotely located from each other and linked via one or more wired and/or wireless connections. For example, the cloud network may include a single server wired directly or indirectly to a router that wirelessly communicates with a wirelessly controlled device such as the wirelessly controlled inflator. The server may store instructions for operating the wirelessly controlled device, and/or may relay instructions to the wirelessly controlled device from another cloud-networked device. In some embodiments, the cloud network includes a central server and one or more user nodes. A user may provide instructions to the wirelessly controlled device via the user node and the central server, or may bypass the central server and communicate directly with the wirelessly controlled device. For example, in some embodiments, the user node may store communication instructions that route communications directly to the wirelessly controlled device when within the signal range of a given wireless communication means (e.g. Bluetooth, etc.), and outside that signal range may route communications to the wirelessly controlled device via the server.

The cloud network may include one or more network devices, such as those depicted. The network devices may, in various embodiments, include one or more servers, one or more personal computers, one or more laptop computers, one or more smartphones, and/or one or more tablet computers. Such devices may be real and/or virtual. For example, the cloud network may include a virtual server implemented on a personal computer, a single server blade, or a server cluster. The devices may be organized as client-server, with a hardware device acting as the server, and other hardware devices acting as clients, or the server may be a virtual server formed on several hardware devices.

The wireless control device may include any of a variety of devices capable of wirelessly communicating with the wirelessly controlled device and/or the cloud network. For example, in the depicted embodiment, the wireless control device includes a software application implemented on a touchscreen smartphone. However, in some embodiments, the wireless control device may include a remote control with tactile buttons. Other wireless control devices may include a tablet, a personal computer, a laptop, and/or a special-purpose device designated for controlling the wirelessly controlled device.

The networked smart device may include any of a variety of additional devices networked directly and/or indirectly to the wirelessly controlled device. Such networked smart devices may include a wirelessly controlled inflator, a wirelessly controlled speaker, a wirelessly controlled light, a wirelessly controlled power cord, a wirelessly controlled motorized lifter, a wirelessly controlled vacuum, a wirelessly controlled radio, and/or one or more wirelessly controlled power tools, among others. The system may include one or more such networked smart devices. The networked smart device may communicate with the wirelessly controlled device via a wired connection and/or a wireless connection, and may include instructions for operation with the wirelessly controlled device. For example, in one embodiment, the wirelessly controlled device is a wirelessly controlled inflator that is networked to two additional smart devices: a speaker/microphone and an LED light. A user provides a verbal command to begin operating the inflator. The microphone relays the verbal command to the inflator's microprocessor. The microprocessor interprets the verbal command received from the microphone, and performs an operation, such as activating the inflator. The inflator's microprocessor may also include instructions to turn on the LED light when the inflator is activated, and may send a wireless signal to the LED light to turn on as the inflator is activated.

Figure 2:
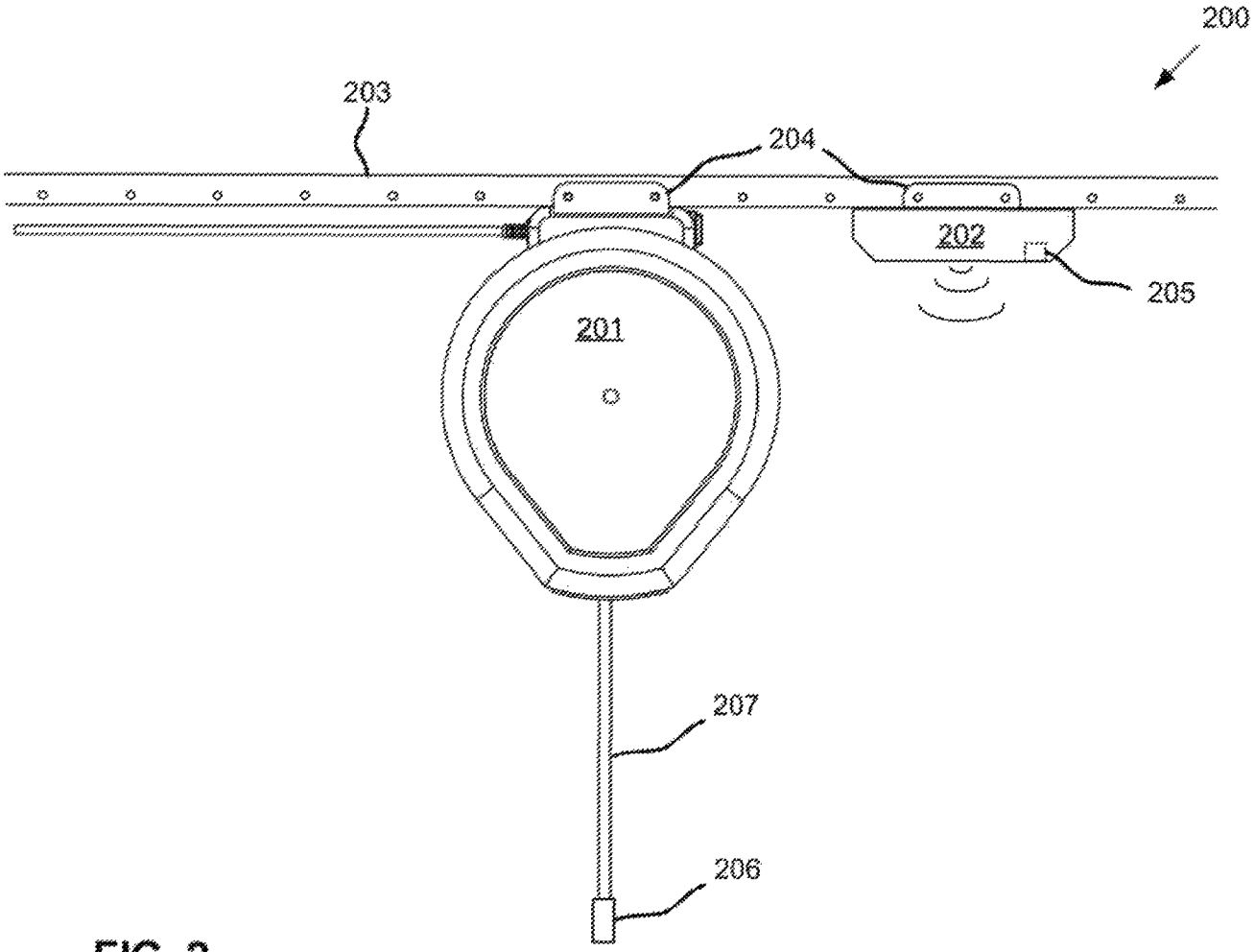
FIG. 2 depicts a mounted inflator and a corresponding networked device.

FIG. 2 depicts a mounted inflator and a corresponding networked device. The system 200 includes a wirelessly controlled inflator 201, a wirelessly controlled speaker 202, a mounting track 203, and universal mounting brackets 204. The mounting track may allow the inflator and the speaker to be mounted, via the universal mounting brackets, to a ceiling or other overhead surface. Though the inflator and speaker may not be placed at a convenient reaching height, both devices may be wirelessly controlled, as is described above. The inflator may include some and/or all of the features described above. Additionally, the speaker may include a microphone 205 that allows a user to provide verbal instructions to the speaker and/or inflator. A connection mechanism 206 may be coupled to the end of a flexible hose 207 extending from the inflator that allows the inflator to connect to any of a variety of inflatable objects and/or pneumatic tools.

Figure 3:
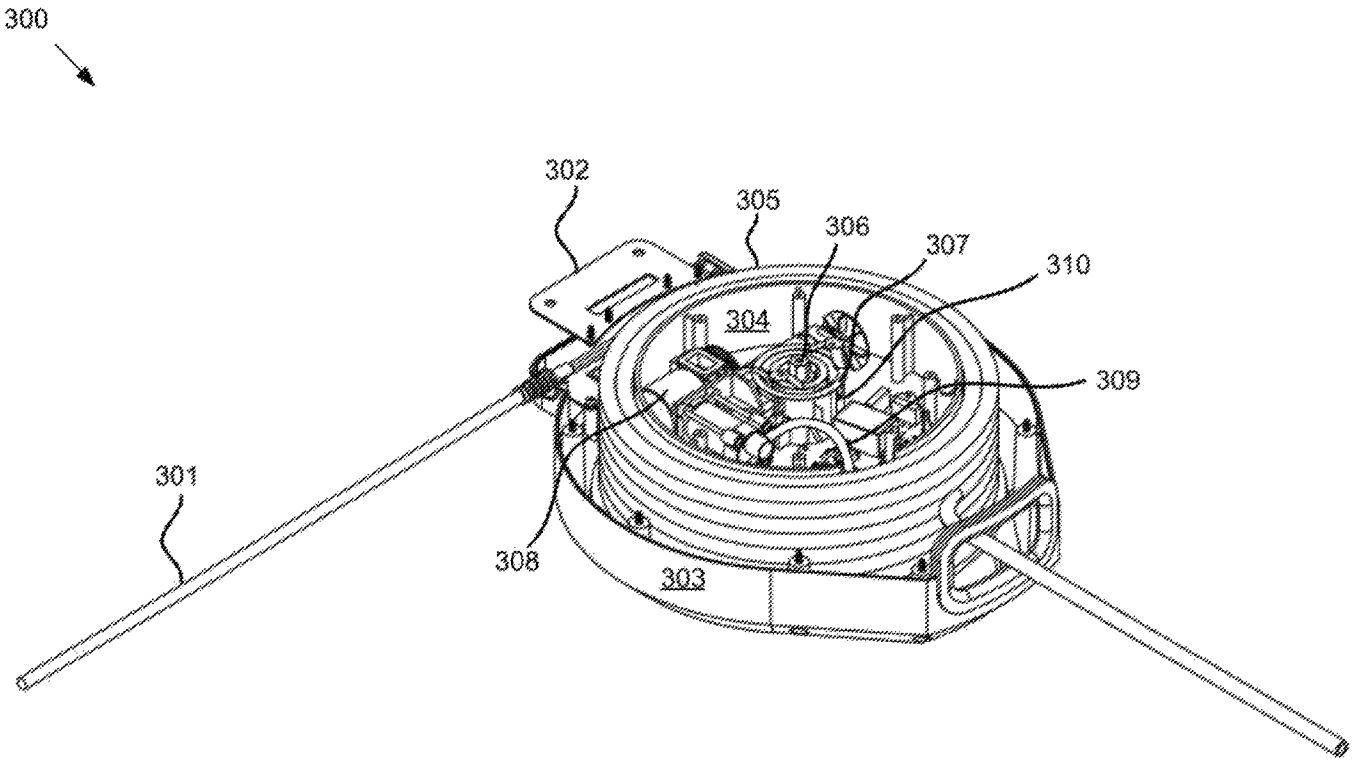
FIG. 3 depicts an isometric view of an inflator embodiment with portions of the first and second housings removed to expose various internal components.

FIG. 3 depicts an isometric view of an inflator embodiment with portions of the external (e.g. second) and internal (e.g. first) housings removed to expose various internal components. The inflator 300 includes a power cord 301, a mounting bracket 302, an external housing 303, a rotatable drum 304, an air flexible hose 305, a drum pivot 306, slip rings 307, a pump 308, and a printed circuit board 309. The pump and printed circuit board are fixed to the interior surface of the drum, and thus rotate with the drum as the air flexible hose is wound on, and unwound from, the drum. Electrical wiring couples the slip rings to the power cord. The slip rings conduct power to the electrical components, such as the pump and the printed circuit board, fixed inside the drum. The slip rings are coupled to the drum by columns 310 extending from the drum.

The printed circuit board may support various electronic components for controlling the pump. Such components may include a transceiver, a controller, and a pressure sensor. The controller may store instructions for operating the pump based on control instructions received via the receiver.

Figure 4:
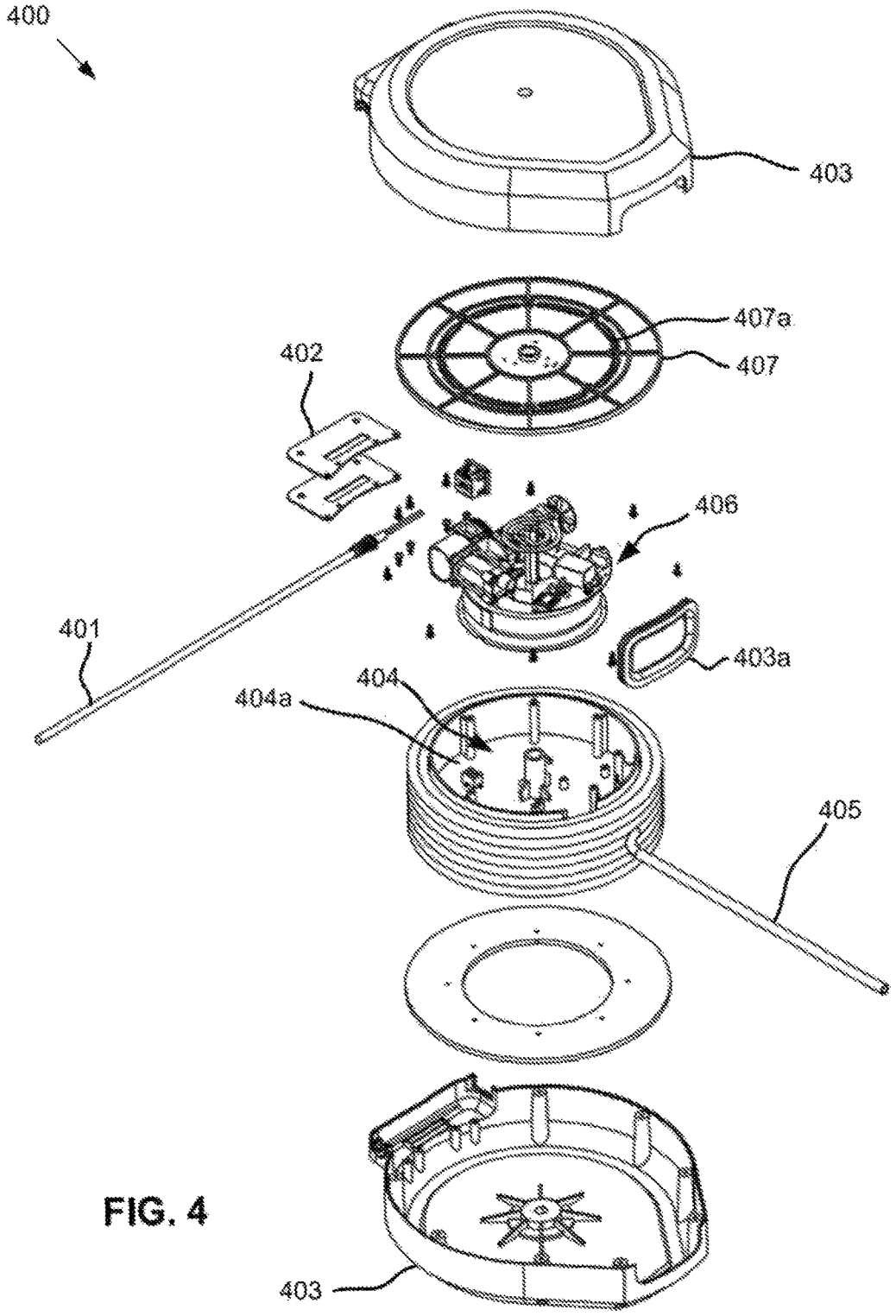
FIG. 4 depicts an exploded view of an inflator embodiment.

FIG. 4 depicts an exploded view of an inflator embodiment. The inflator 400 includes a power cord 401, a mounting bracket 402, external housing 403 including an air vent 403*a*, a rotatable drum 404, a drum divider 404*a*, an air flexible hose 405, internal drum components 406, and an internal housing 407 with air vents 407*a*. The internal drum components, which include the pump and various electronics, are sealed within the drum by the baffle. Space is provided between the baffle and the housing such that air flows through the flexible hose opening and the baffle to the pump. The structure of the baffle and the housing provide some noise attenuation. The drum divider provides a surface on which the internal components may be mounted, which may include a pump, a printed circuit board, and a rewind mechanism.

Figure 5:
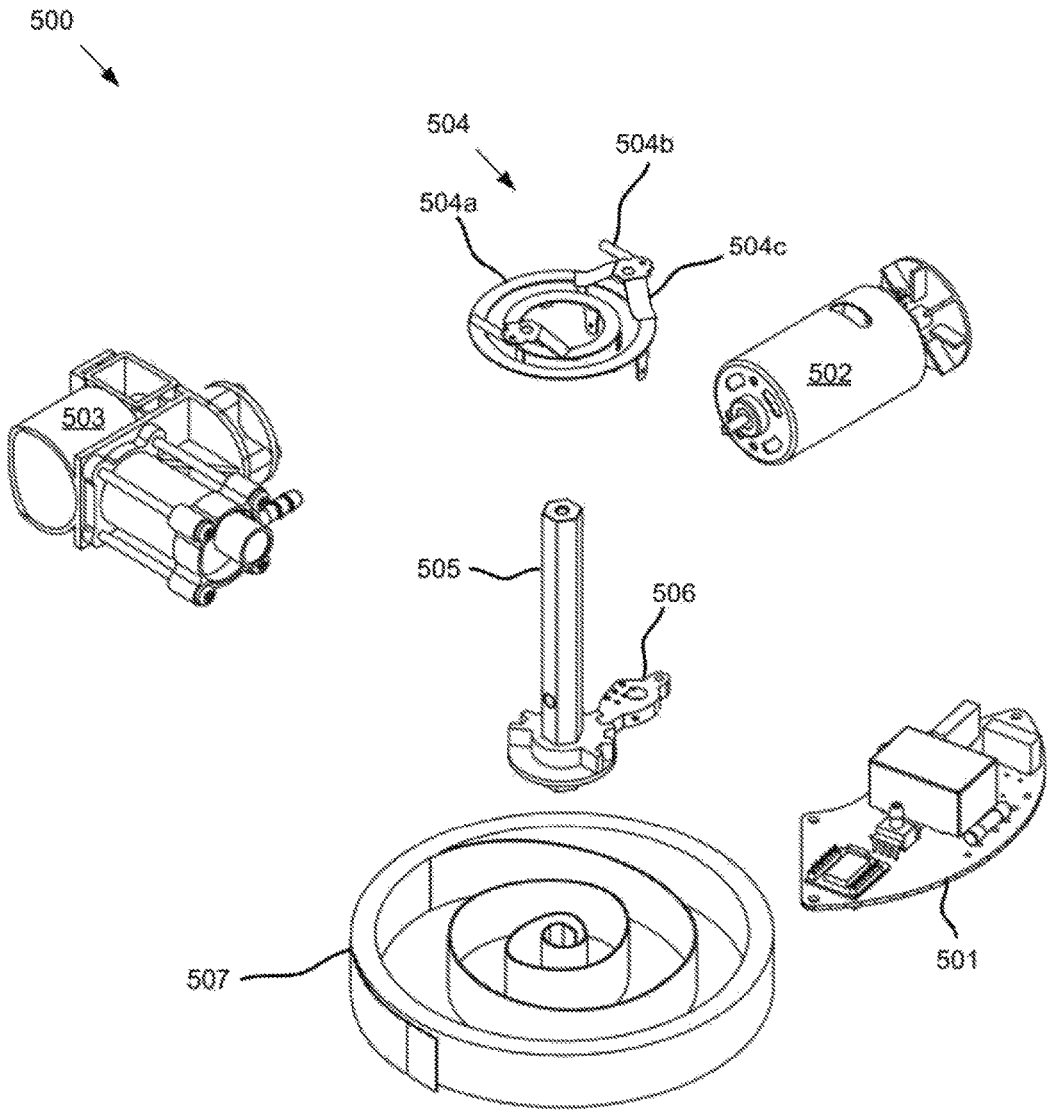
FIG. 5 depicts an exploded view of various internal components of an inflator embodiment.

FIG. 5 depicts an exploded view of various internal components of an inflator embodiment. The inflator 500 includes a printed circuit board 501, a motor 502, a pump 503, an electrical power transmission mechanism 504, a drum pivot 505, a pawl mechanism 506, and a recoil spring 507. The electrical power transmission mechanism includes slip rings 504*a*, power lines 504*b*, and conductive brushes 504*c*. The slip rings provide power to the printed circuit board and the motor. The motor drives the pump. The recoil spring is fixed at one end to the drum pivot and at the other end to the drum, and enables the drum to rewind the flexible hose. The pawl mechanism fixes the drum and prevents the spring from recoiling. As used herein, "recoil" refers to a return to a state of equilibrium of a spring, either from compression, expansion, coiling, or uncoiling.

Figure 6:
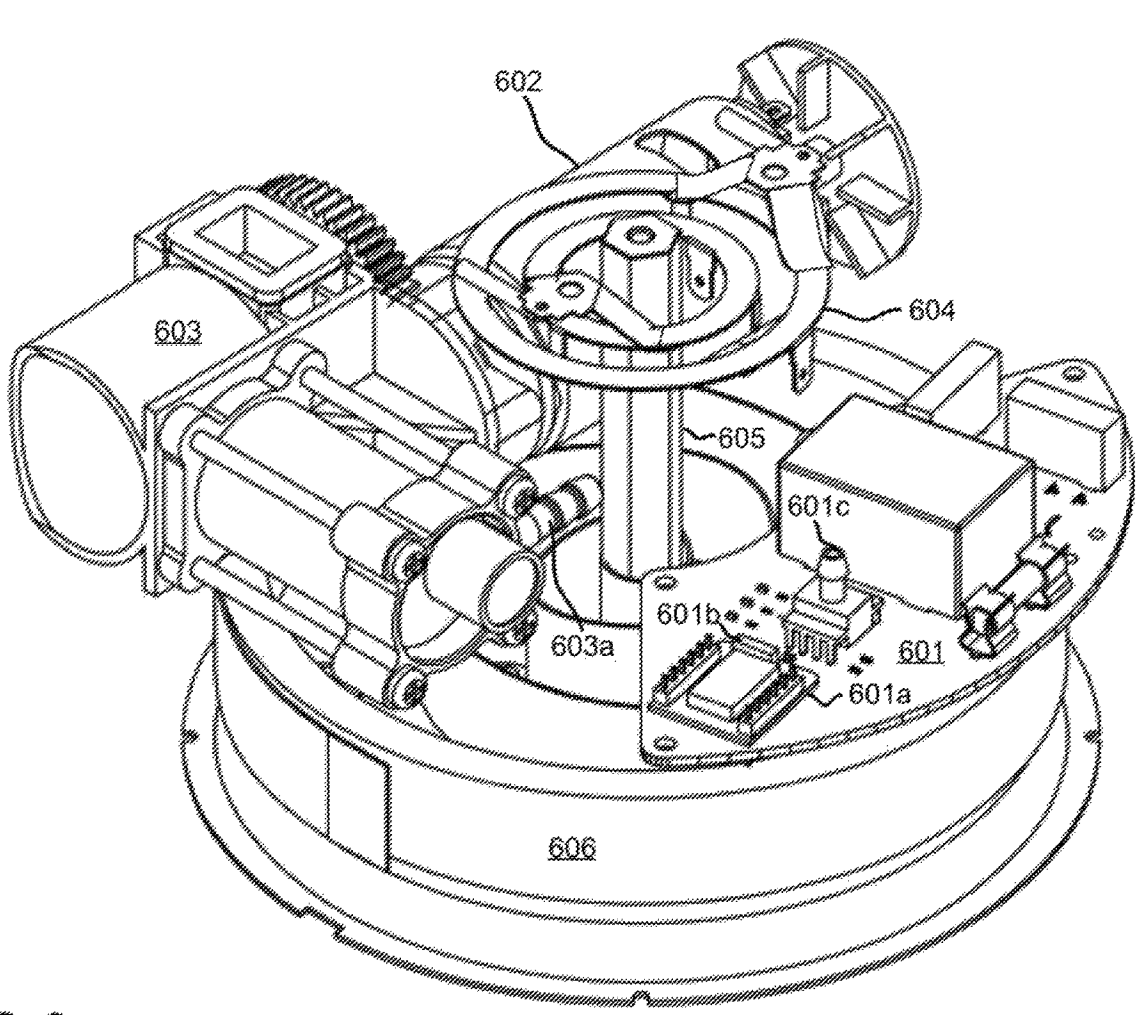
FIG. 6 depicts an assembled view of various internal components of an inflator embodiment.

FIG. 6 depicts an assembled view of various internal components of an inflator embodiment. The inflator 600 includes a printed circuit board 601 having a programmable switch 601*a* and a wireless transceiver 601*b*, a pressure sensor 601*c*, a motor 602, a pump 603, a flexible hose barb adaptor 603*a*, slip rings 604, a drum pivot 605, and a recoil spring 606. A flexible hose couples to the pump via the barb adaptor, then to a t-connector (not shown), which couples to another flexible hose and the pressure sensor. The second flexible hose wraps around the drum within which the depicted components are disposed.

Figure 7:
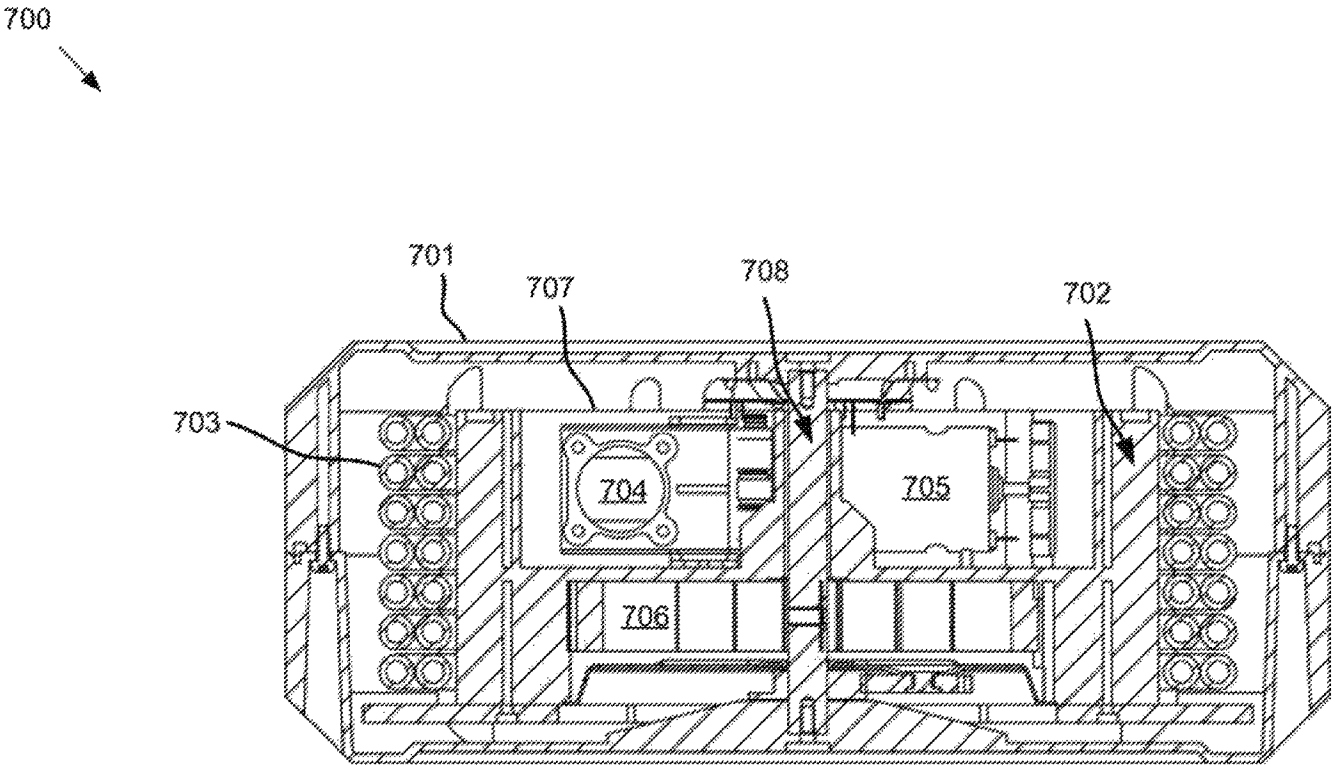
FIG. 7 depicts a cross-sectional view of an inflator embodiment.

FIG. 7 depicts a cross-sectional view of an inflator embodiment. The inflator 700 includes external housing 701, a drum 702, a flexible hose 703, a pump 704, a motor 705, a recoil spring 706, internal housing 707, and a pivot mechanism 708. The external housing completely surrounds the drum, flexible hose, pump, motor, and recoil spring, and the flexible hose extends from the drum through the housing similar to that described above. The pivot mechanism is affixed to the external housing, and the drum rotates about the pivot mechanism.

Figure 8:
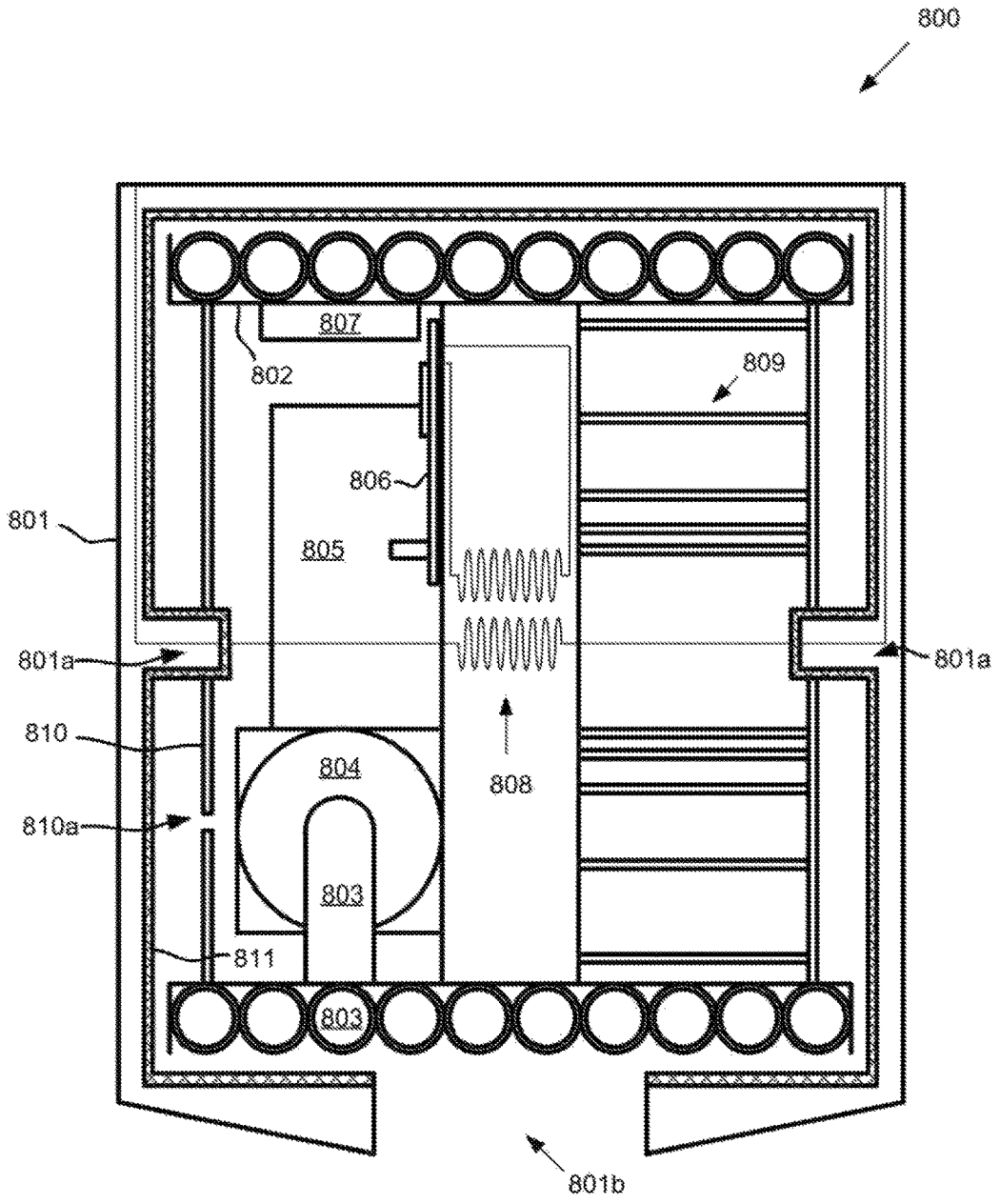
FIG. 8 depicts a cross-section of a cylindrical inflator embodiment.

FIG. 8 depicts a cross-section of a cylindrical inflator embodiment. The inflator 800 includes an external housing 801, a pivot mechanism 801*a*, an external air vent 801*b*, a drum 802, a flexible hose 803, a pump 804, a motor 805, a printed circuit board 806, a counter-weight 807, an electrical power transmission mechanism 808, a rewind mechanism 809, and an internal housing 810 with an internal air intake 810*a*. The external housing includes, on the interior surface, a layer 811 of mass-loaded vinyl. The pivot mechanism extends into the internal housing, which is fixed to the drum, thereby enabling rotation of the drum. The rewind mechanism is affixed to the pivot mechanism. The mass-loaded vinyl may extend over the pivot mechanism, and may include a Teflon coating that reduces friction between the pivot mechanism and the internal housing.

The pump draws air in through the external and internal air intakes. Sound emanating from the pump is directed through the internal air intake towards the mass-loaded vinyl layer. The mass-loaded vinyl layer attenuates at least some of the sound. Unattenuated/reflected sound passes between the internal and external housings, continuously being absorbed and/or reflected and further attenuated. The sound passes over at least a portion of the flexible hose, and is absorbed by the flexible hose.

Figure 9:
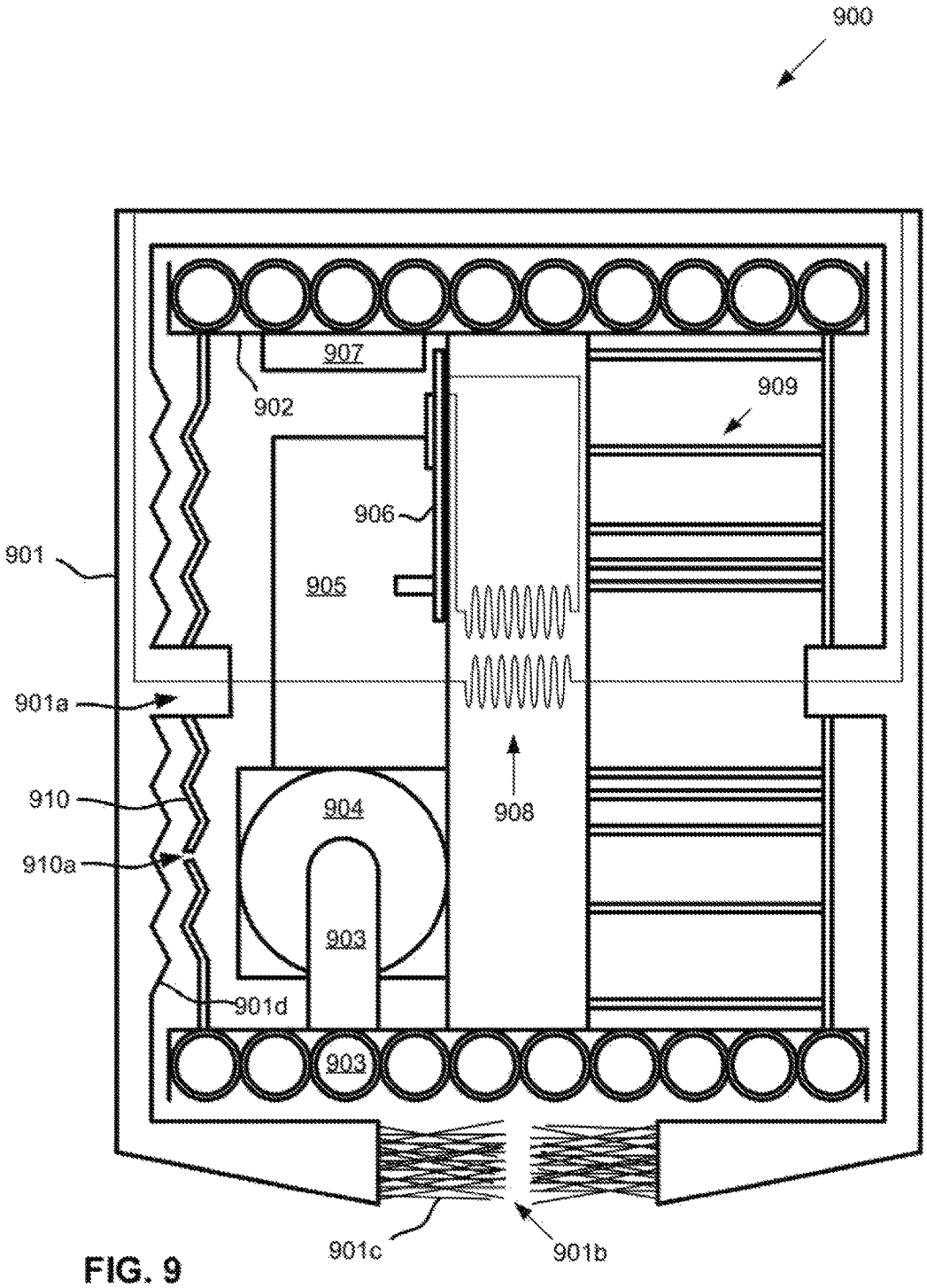
FIG. 9 depicts a cross-section of a cylindrical inflator embodiment.

FIG. 9 depicts a cross-section of a cylindrical inflator embodiment. The inflator 900 includes an external housing 901, a pivot mechanism 901*a*, an external air vent 901*b*, brushes 901*c*, a drum 902, a flexible hose 903, a pump 904, a motor 905, a printed circuit board 906, a counter-weight 907, an electrical power transmission mechanism 908, a rewind mechanism 909, and an internal housing 910 with an internal air intake 910*a*. The brushes clean the flexible hose and help attenuate sound emanating from the inflator. An opening may be left between the brushes to allow room for the flexible hose, or the brushes may meet in the middle of the external air intake, the flexible hose bending and rubbing against the brushes as it is drawn onto the drum. An interior surface 901*d* of the external housing is non-linearly shaped, and complementary to the shape of the internal housing. This allows for additional attenuation of sound.

Figure 10:
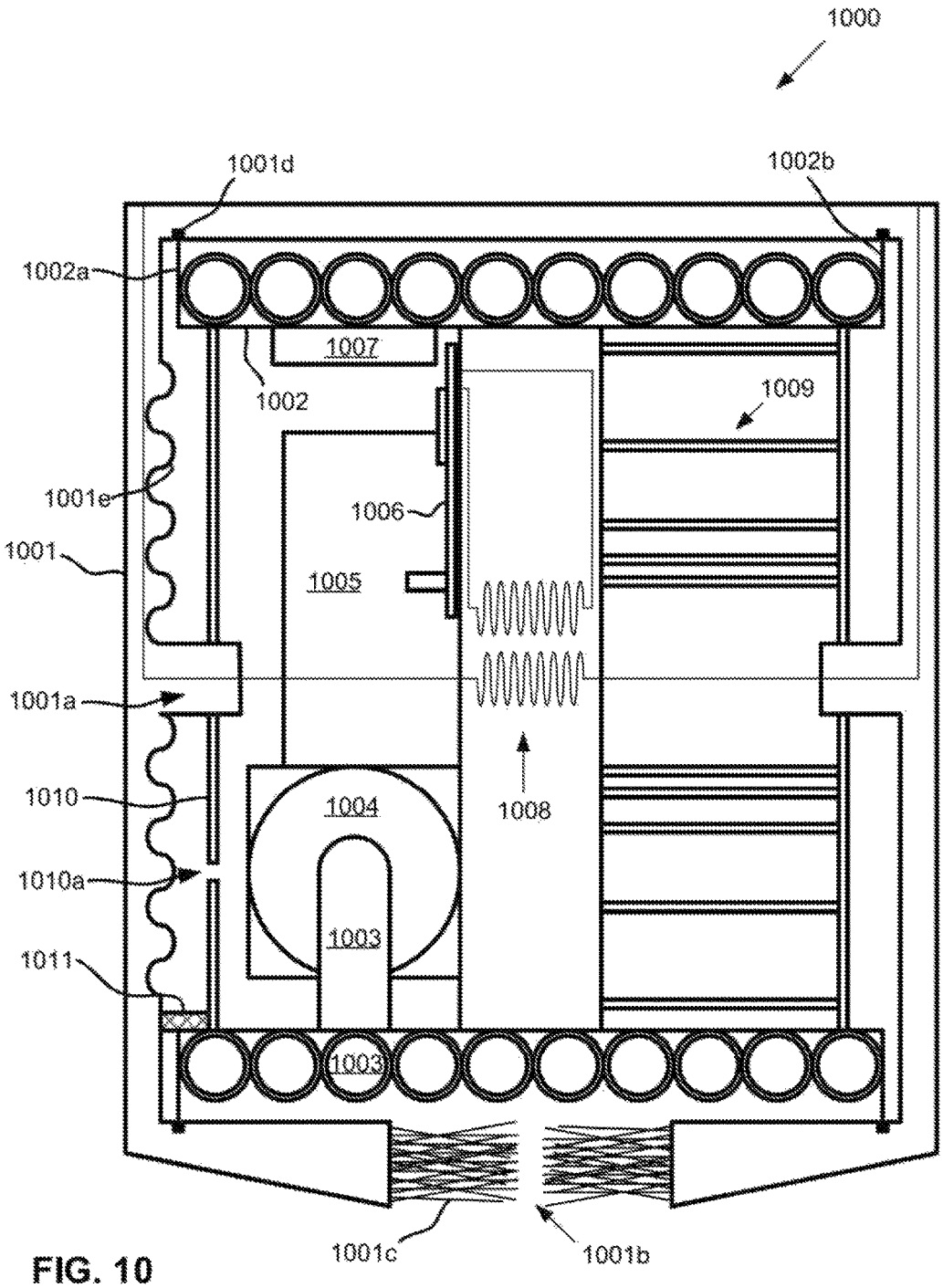
FIG. 10 depicts a cross-section of a cylindrical inflator embodiment.

FIG. 10 depicts a cross-section of a cylindrical inflator embodiment. The inflator 1000 includes an external housing 1001, a pivot mechanism 1001*a*, an external air vent 1001*b*, brushes 1001*c*, grooves 1001*d*, an interior surface 1001*e*, a drum 1002, a first sound barrier 1002*a*, a second sound barrier 1002*b*, a flexible hose 1003, a pump 1004, a motor 1005, a printed circuit board 1006, a counter-weight 1007, an electrical power transmission mechanism 1008, a rewind mechanism 1009, an internal housing 1010 with an internal air intake 1010*a*, and a third sound barrier 1011 formed of mass-loaded vinyl.

Figure 15:
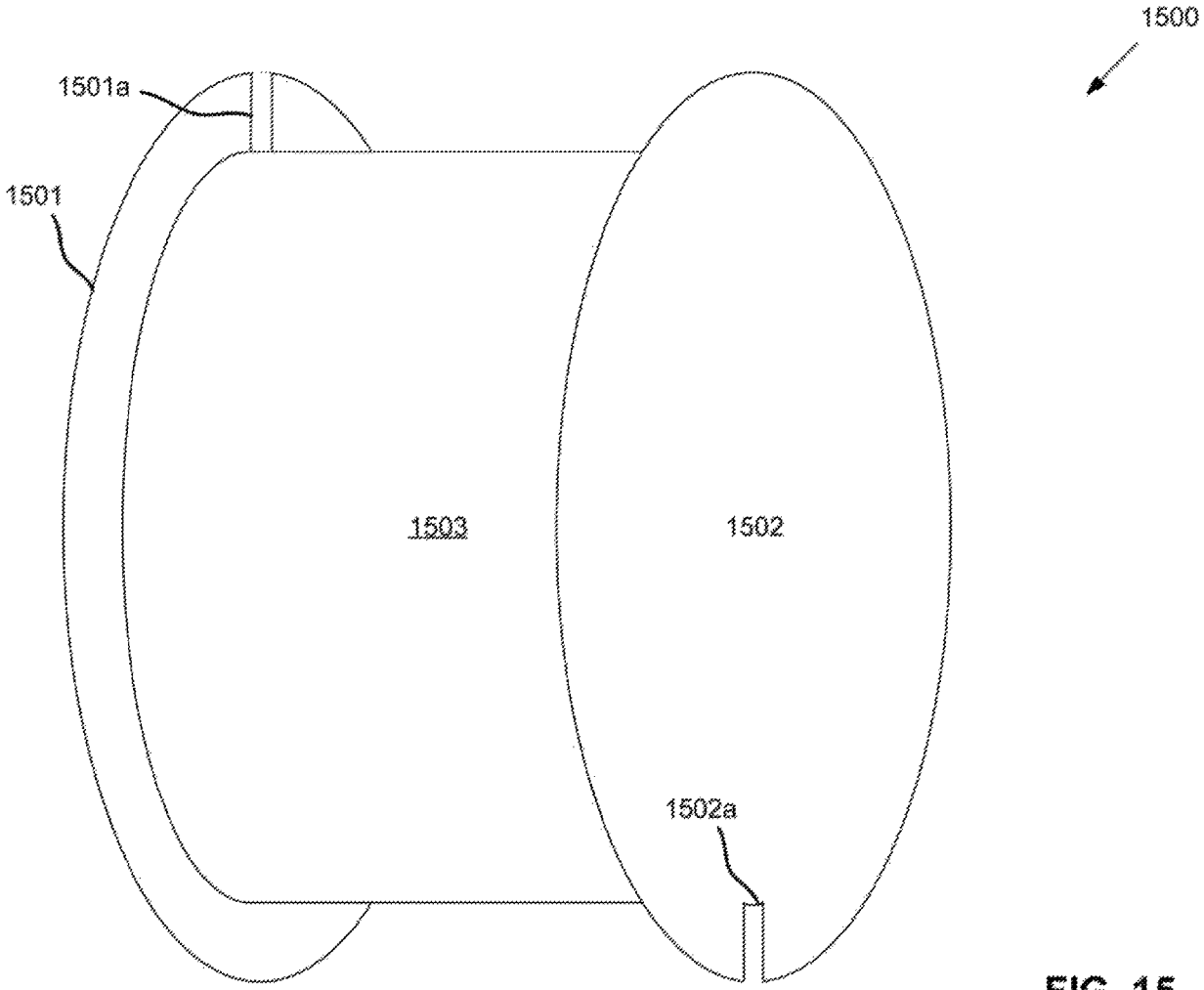
FIG. 15 depicts an isometric line view of a cylindrical drum embodiment.

The first and second sound barriers sit in the grooves in the external housing. The first and second sound barriers are formed by upturned edges of the drum. In some embodiments, the grooves or the sound barriers may include bearings or a friction-resistant material, such as Teflon, to allow for easier movement of the sound barriers in the grooves. Additionally, in some embodiments, the first and second sound barriers may be comprised at least partially of a sound-attenuating material such as mass-loaded vinyl. Although not depicted, the first and second sound barriers each include air intakes that allow air and sound to pass over the flexible hose. An example of such intakes is depicted in FIG. 15. The third sound barrier extends perpendicularly between the external and the internal housings along the shortest path between the internal and external air intakes. This reflects sound within the external housing over, for example, the flexible hose. Such a configuration further attenuates sound emitted by the inflator. The interior surface of the external housing is corrugated to further reflect sound and increase attenuation.

Figure 11:
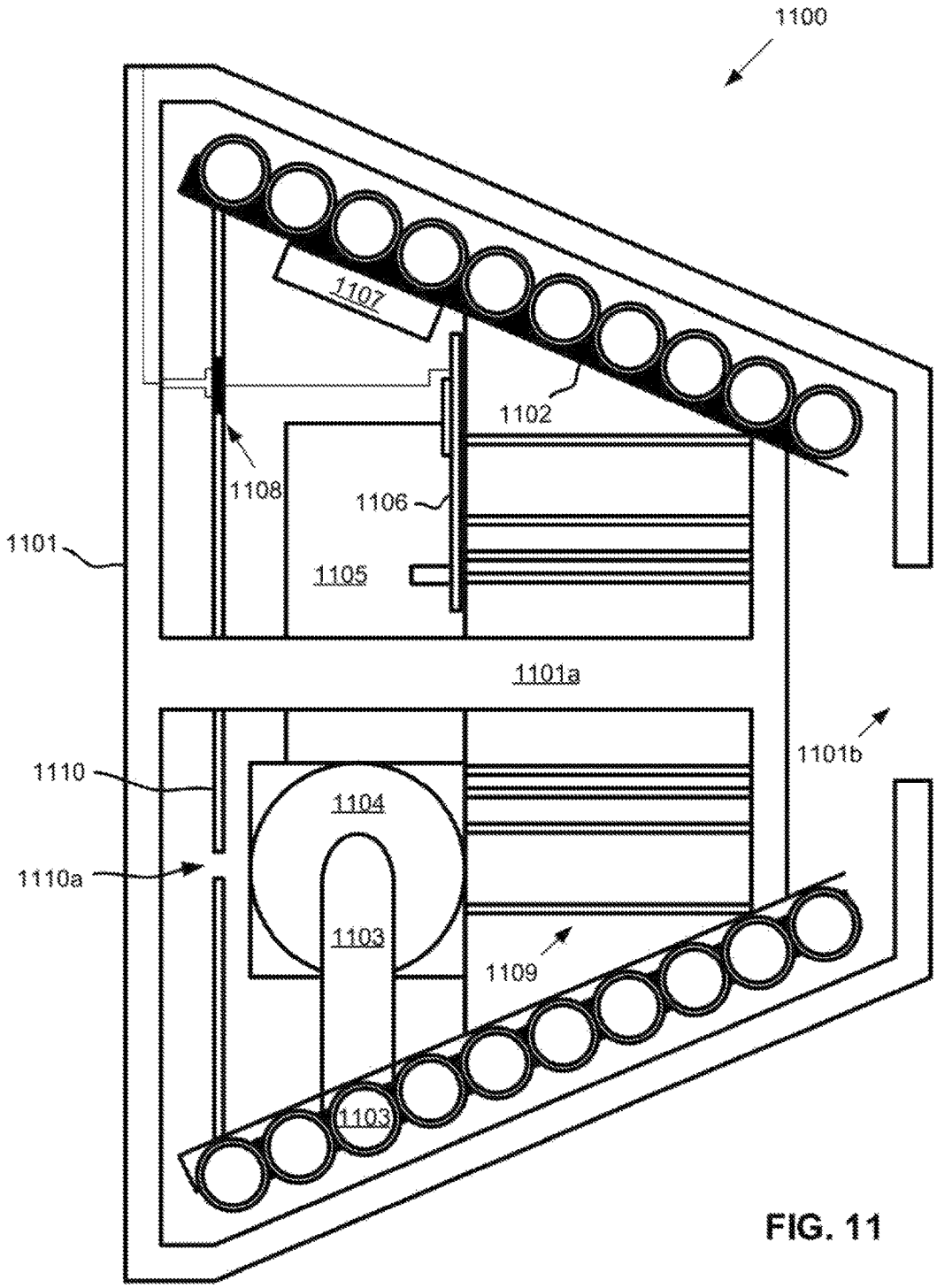
FIG. 11 depicts a cross-section of a conical inflator embodiment.

FIG. 11 depicts a cross-section of a conical inflator embodiment. The inflator 1100 includes an external housing 1101, a pivot mechanism 1101*a*, an external air vent 1101*b*, a drum 1102, a flexible hose 1103, a pump 1104, a motor 1105, a printed circuit board 1106, a counter-weight 1107, an electrical power transmission mechanism 1108, a rewind mechanism 1109, and an internal housing 1110 with an internal air intake 1110*a*. The internal air intake is disposed along the wide end of the conical drum, and the external air intake is disposed along the narrow end of the drum. The external housing has conical shape corresponding to the shape of the drum. The drum is helically grooved to aid with winding the flexible hose onto the drum.

Figure 12:
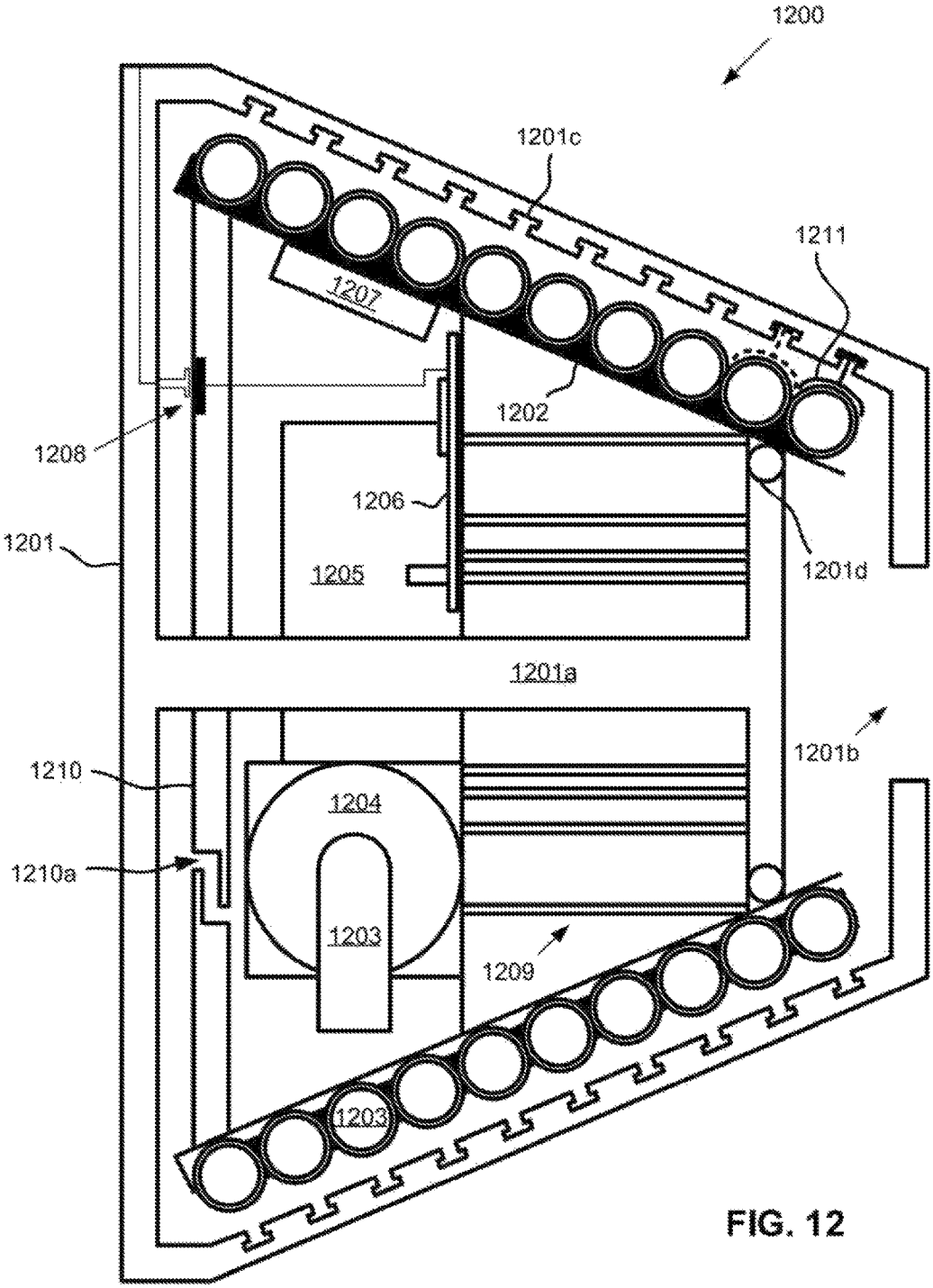
FIG. 12 depicts a cross-section of a conical inflator embodiment.

FIG. 12 depicts a cross-section of a conical inflator embodiment. The inflator 1200 includes an external housing 1201, a pivot mechanism 1201*a*, an external air vent 1201*b*, a helical groove 1201*c*, bearings 1201*d*, a drum 1202, a flexible hose 1203, a pump 1204, a motor 1205, a printed circuit board 1206, a counter-weight 1207, an electrical power transmission mechanism 1208, a rewind mechanism 1209, an internal housing 1210 with an internal air intake 1210*a*, and a flexible hose guide 1211 over the flexible hose and slidably fixed within the helical groove. The flexible hose guide slides along the groove as the flexible hose is wound onto and unwound from the drum to align the flexible hose with the helical groove in the drum. The internal air vent is depicted as a double-walled baffle. The double-wall construction redirects sound, furthering sound attenuation.

Figure 13:
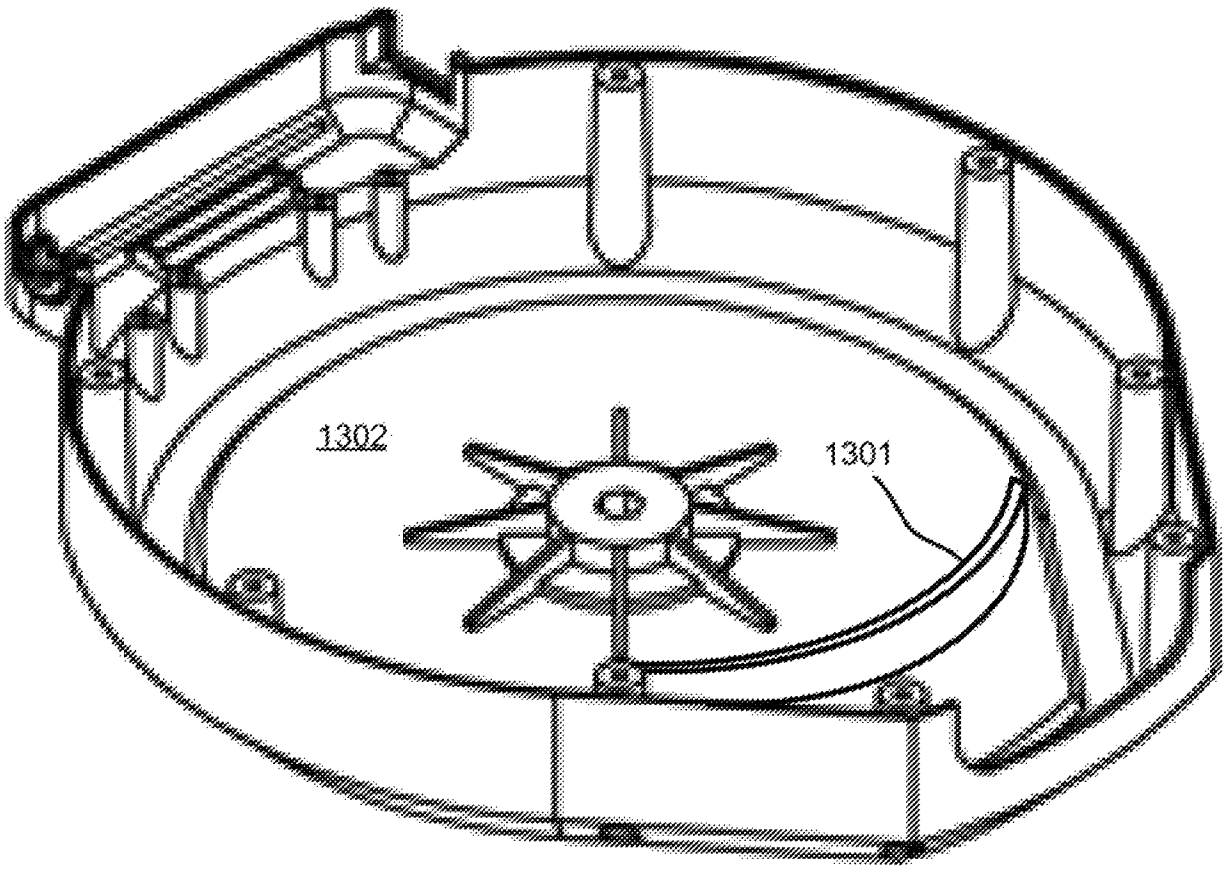
FIG. 13 depicts an isometric view of an inflator external housing embodiment with a sound barrier embodiment.

FIG. 13 depicts an isometric view of an inflator external housing embodiment with a sound barrier embodiment. The sound barrier 1301 is affixed to an interior surface of the housing 1302, and forms a semi-circle.

Figure 14:
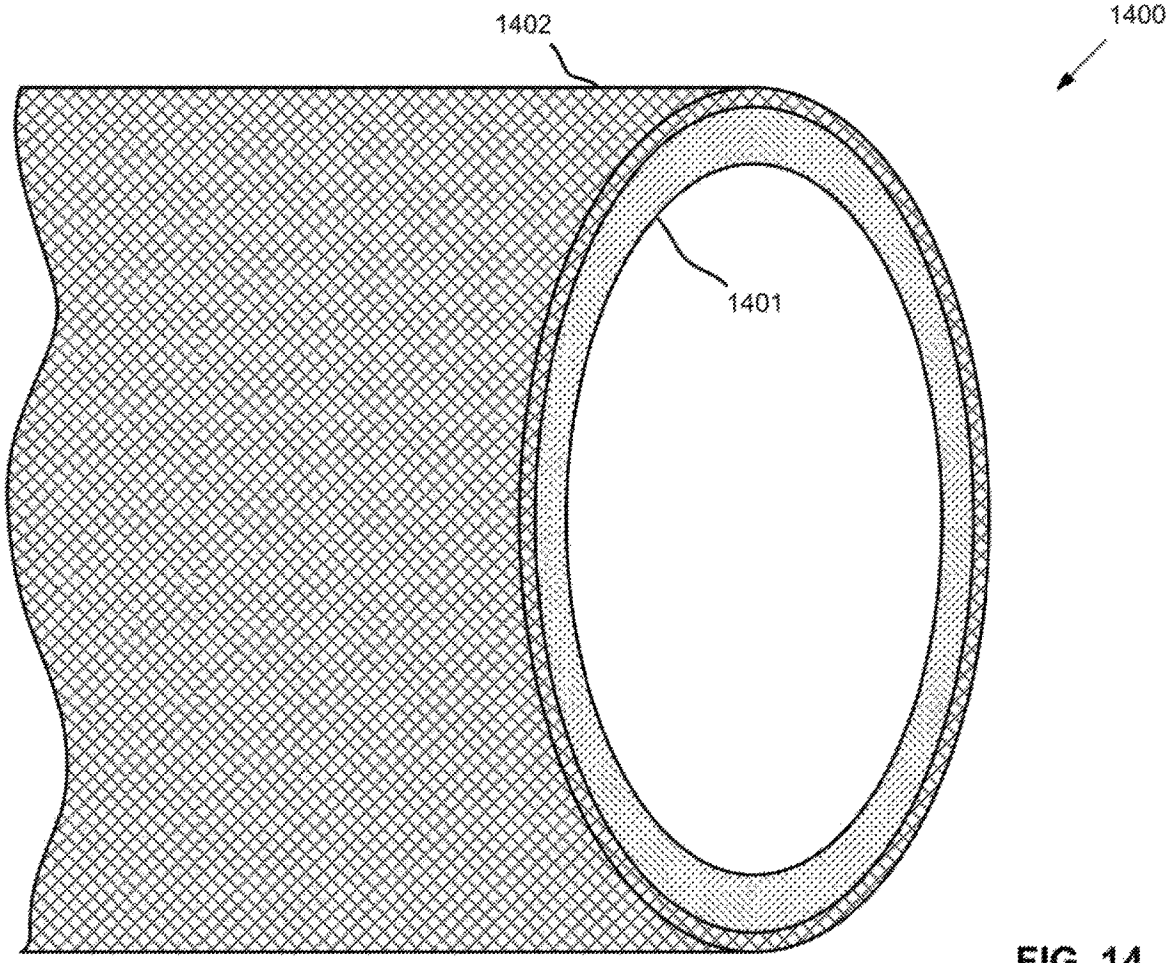
FIG. 14 depicts a cross-sectional view of a flexible hose embodiment.

FIG. 14 depicts a cross-sectional view of a flexible hose embodiment. The flexible hose 1400 includes a flexible plastic body 1401 and a mass-loaded vinyl sheath 1402. The body is reinforced with nylon fibers.

FIG. 15 depicts an isometric line view of a cylindrical drum embodiment. The drum 1500 includes a first sound barrier 1501 with an air intake 1501*a*, a second sound barrier 1502 with an air intake 1502*a*, and a drum body 1503. The air intakes are disposed adjacent to opposite sides and opposite ends of the drum body. This requires sound traveling through the air intakes to pass over the flexible hose, increasing sound attenuation.

We claim:

1. An inflator, comprising:

a rotatable drum that draws in and lets out a flexible hose, the hose comprising a first end and a second end, the first end having a connection mechanism that connects the hose to an inflatable object;

a first housing enclosing an inner portion of the drum, the first housing comprising a first air intake;

an air pump disposed within the first housing and connected to the second end of the hose; and a second housing surrounding the drum and comprising a second air intake, wherein the hose passes through the second air intake, and wherein first air intake is aligned at perpendicularly to the second air intake, wherein the first and second housings are arranged such that sound emitted from the pump passes over the hose within the second housing, and is at least partially absorbed by the hose.

2. The inflator of claim 1, the first housing, the second housing, or both comprising one or more sound attenuating materials, the sound attenuating materials having a sound transmission class of at least 25.

3. The inflator of claim 1, the first housing, the second housing, or both comprising mass-loaded vinyl.

4. The inflator of claim 1, the first housing, the second housing, or both comprising mass-loaded vinyl having a thickness ranging from one sixteenth of an inch to half an inch.

5. The inflator of claim 1, wherein the second housing comprises a solid wall adjacent to the first air intake and parallel to the first housing.

6. The inflator of claim 1, the first and second housing having complementary non-linear surfaces.

7. The inflator of claim 1, further comprising a sound barrier disposed between the first and second housings perpendicular to the first and second housings, wherein the sound barrier closes off a shortest path between the first and second air intakes and redirects sound emitted through the first air intake over the hose and through the second air intake.

8. The inflator of claim 1, further comprising one or more brushes disposed in the second air intake surrounding a portion of the hose passing through the second air intake, wherein the brushes clean off the hose as it is wound onto the drum, and wherein the brushes have a density, thickness, or density and thickness great enough to form a barrier having a sound transmission class of at least 10, thereby attenuating sound passing through the second air intake.

9. The inflator of claim 1, wherein the hose comprises a layer of mass-loaded vinyl.

10. The inflator of claim 1, wherein an interior surface of the second housing is corrugated to attenuate sound.

11. An inflator, comprising:

a drum and a hose, the hose comprising a first end and a second end, the first end having a connection mechanism that connects the hose to an inflatable object;

a first housing enclosing an inner portion of the drum, the first housing comprising a first air intake;

an air pump disposed within the first housing and connected to the second end of the hose; and a second housing surrounding the drum and comprising a second air intake, wherein the hose passes through the second air intake, and wherein first air intake is aligned parallel to the second air intake on a side of the drum opposite the second air intake, wherein the first and second housings are arranged such that sound emitted from the pump passes over the hose within the second housing, and is at least partially absorbed by the hose.

12. The inflator of claim 11, further comprising a first sound barrier disposed around the drum extending from the drum to the second housing along a first end of the drum, and a second sound barrier disposed around the drum extending from the drum to the second housing along a second end of the drum opposite the first end.

13. The inflator of claim 11, further comprising a first sound barrier disposed around the drum extending from the drum to the second housing along a first end of the drum, and a second sound barrier disposed around the drum extending from the drum to the second housing along a second end of the drum opposite the first end, wherein the first sound barrier comprises a third air intake, and wherein the second sound barrier comprises a fourth air intake.

14. The inflator of claim 11, further comprising a first sound barrier disposed around the drum extending from the drum to the second housing along a first end of the drum, and a second sound barrier disposed around the drum extending from the drum to the second housing along a second end of the drum opposite the first end, wherein the first sound barrier comprises a third air intake, and wherein the second sound barrier comprises a fourth air intake, the third air intake disposed on a side of the drum opposite the fourth air intake.

15. The inflator of claim 11, further comprising a first sound barrier disposed around the drum extending from the drum to the second housing along a first end of the drum, and a second sound barrier disposed around the drum extending from the drum to the second housing along a second end of the drum opposite the first end, the second housing comprising a first groove within which the first sound barrier sits, and a second groove within which the second sound barrier sits.

16. The inflator of claim 11, wherein a portion of the second housing adjacent to the first air intake is solid and unperforated.

17. The inflator of claim 11, wherein at least of a portion of the second housing comprises mass-loaded vinyl.

18. The inflator of claim 11, wherein a portion of the second housing adjacent to the first air intake comprises mass-loaded vinyl.

19. The inflator of claim 11, wherein the first air intake comprises a double-walled baffle.

20. The inflator of claim 11, wherein the drum is conical, wherein the first air intake is adjacent to the wide end of the conical drum, and wherein the second air intake is adjacent to the narrow end of the conical drum.

* * * * *